US009072419B1

(12) United States Patent
Morad et al.

(10) Patent No.: US 9,072,419 B1
(45) Date of Patent: Jul. 7, 2015

(54) APPARATUS TO REMOVE A DISPOSABLE CLOTH FROM A HAND OPERATED SWEEPING MOP APPLICATOR WITHOUT HAVING TO TOUCH THE DISPOSABLE CLOTH

(71) Applicants: Fred I. Morad, Toluca Lake, CA (US); William P. Camp, Jr., Vanlue, OH (US); George Mardres, La Crescenta, CA (US)

(72) Inventors: Fred I. Morad, Toluca Lake, CA (US); William P. Camp, Jr., Vanlue, OH (US); George Mardres, La Crescenta, CA (US)

(73) Assignee: Worldwide Integrated Resources, Inc., Montebello, CA (US)

( * ) Notice: Subject to any disclaimer, the term of this patent is extended or adjusted under 35 U.S.C. 154(b) by 0 days.

(21) Appl. No.: 14/506,561

(22) Filed: Oct. 3, 2014

(51) Int. Cl.
*A47L 13/24* (2006.01)
*A47L 13/256* (2006.01)

(52) U.S. Cl.
CPC ..... *A47L 13/256* (2013.01); *A47L 13/24* (2013.01)

(58) Field of Classification Search
CPC ..... A47L 13/24; A47L 13/256
See application file for complete search history.

(56) References Cited

U.S. PATENT DOCUMENTS

| | | | | |
|---|---|---|---|---|
| 5,461,749 | A * | 10/1995 | Ahlberg et al. | 15/228 |
| 8,677,547 | B1 | 3/2014 | Morad | |
| 8,701,238 | B1 * | 4/2014 | Morad et al. | 15/147.1 |
| 2011/0107539 | A1 * | 5/2011 | Dingert et al. | 15/231 |

* cited by examiner

*Primary Examiner* — Randall Chin
(74) *Attorney, Agent, or Firm* — Thomas I. Rozsa

(57) ABSTRACT

A mop with a disposable cloth retaining assembly where the cloth is retained by cloth retaining members attached to the bottom of attaching plates on a main body, with a right and left cloth releasing plate between the main body and the cleaning cloth, the cloth releasing plates retained in a closed position against the main body by ratchet teeth engaged in notches of a respective notched collar to overcome a force of downward force compression springs. When a retaining force is removed, the downward spring force of force compression springs causes the cloth releasing plate to move away from the main body, the downward movement of the cloth releasing plate being limited. The cleaning cloth is separated from the cloth retaining members so that the dirty cleaning cloth falls away.

6 Claims, 14 Drawing Sheets

APPARATUS TO REMOVE A DISPOSABLE CLOTH FROM A HAND OPERATED SWEEPING MOP APPLICATOR WITHOUT HAVING TO TOUCH THE DISPOSABLE CLOTH

BACKGROUND OF THE INVENTION

1. Field of the Invention

The present invention relates to the field of hand operated sweeping mops which retain a disposable cleaning cloth which can be a microfiber cloth or a non-woven cloth.

2. Description of the Prior Art

In general, various types of hand operated sweeping mops are known in the prior art.

The hand operated sweeping mops include a generally rectangular shaped main body having an upper or top surface which includes a rotatable yolk attached to a collar having an opening which receives an elongated handle which is grasped by a user when operating the sweeping mop.

The main body also has a flat lower or bottom surface with a disposable cleaning cloth affixed to the sweeping mop applicator so that the disposable cleaning cloth is positioned under the lower or bottom surface and is retained onto the main body by various different retaining members.

In one retaining member configuration, the lower surface of the main body has hook and loop fasteners affixed to the lower surface and the disposable cleaning cloth is retained onto the lower surface of the main body by the hook and loop fasteners. In another configuration, the disposable cleaning cloth is retained onto the main body by several attachment members usually positioned on the upper surface on opposite sides of the yolk so that the disposable cleaning cloth is wrapped around the outer circumference of the main body and then attached by the attachment members to the sweeping mop.

One common problem with all prior art hand operated sweeping mop applicators also called flat mop applicators is that when the disposable cloth is very dirty after cleaning operations, the user must use at least one of his/her hands to grasp the dirty cleaning cloth and remove it from its attachment member on the sweeping mop applicator also called a flat mop applicator. Therefore, the user is exposed to the filth and dirt on the disposable cleaning cloth. There is a significant need for an improved apparatus which eliminates the requirement for a user to grasp the dirty cleaning cloth by hand when removing it from the sweeping mop applicator or flat mop applicator and replacing it.

This invention contains improvements over a prior issued U.S. Pat. No. 8,677,547 by inventors Fred I. Morad, William P. Camp, Jr. and George Madres entitled "APPARATUS TO REMOVE A DISPOSABLE CLOTH FROM A HAND OPERATED SWEEPING MOP APPLICATOR WITHOUT HAVING TO TOUCH THE DISPOSABLE CLOTH". The improvements which are contained in this invention are described in great detail concerning the anti-vibration members which are described in great detail in FIG. 6 and FIG. 7 and described in great detail in the text when referring to FIG. 6 and FIG. 7 and are limitations in the independent claims. These improvements help stabilize the mop while it is mopping and are significant improvements over the invention disclosed in the above-referenced patent by the same inventors.

SUMMARY OF THE INVENTION

The present invention is a hand operated sweeping mop applicator with a unique disposable cloth retaining assembly where the cloth is retained by spikes on a cloth releasing plate and a press-fit of the cloth resting under and partially wrapped around the top of a cloth releasing plate where the cloth is press fit retained between the top of the cloth releasing plate and the bottom of a main plate. The cloth releasing plate is retained in a closed position against the main body by a respective biasing force spring causing each respective one of ratchet teeth to engage in a respective notch of a respective notched collar on the main body to thereby overcome a force from a pair of downward force compression springs on the cloth releasing plate. This assembly is retained by a respective housing on the main body. The cloth is selected from the group consisting of a microfiber cloth and a non-woven cloth.

When a respective button attached to a respective tooth is pressed down to overcome the biasing spring force which caused the teeth to be engaged with the notches, the downward spring force of each of the respective force compression springs causes the cloth releasing plate to move away from the main body.

It is an object of the present invention to provide a mechanism on a hand operated sweeping mop applicator which retains a cleaning cloth in a manner which enables the cleaning cloth after it has been used and become dirty to be released and fall into a trash receptacle without the necessity of a user's hand touching the dirty cleaning cloth.

It is also an object of the present invention to provide a mechanism for a hand operated sweeping mop applicator which includes a spring force to push downwardly on a cloth releasing plate to enable the dirty cleaning cloth to be separated from the press fit which retains the disposable cleaning cloth between the main body of the sweeping mop applicator and the cloth releasing plate so that the connection is released, enabling the disposable cleaning cloth to be released without requiring a human hand to touch the dirty cleaning cloth.

It is an additional object of the present invention to provide a mechanism which limits the downward travel of a cloth releasing plate so that it will not fall away from the main body of the sweeping mop applicator.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claim.

Figure 1:
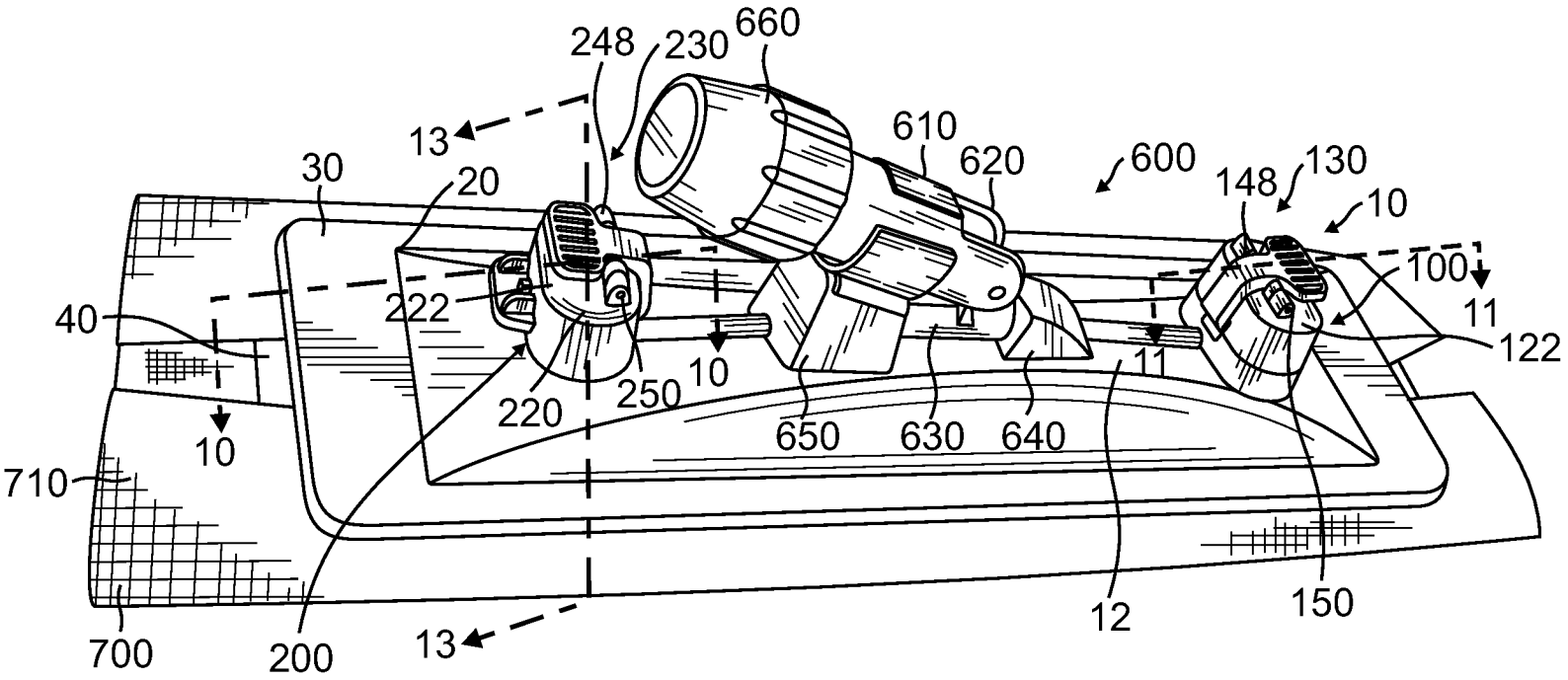
FIG. 1 is a top perspective view of the present invention main plate with a main body of a hand operated sweeping mop applicator illustrating the retainer for a rotatable yolk which retains a collar into which an elongated handle is retained (handle not shown), also illustrating a middle cloth releasing plate affixed to a foam cover plate, the disposable cloth under the foam plate and partially wrapped around the top of the middle cloth releasing plate, the top of the cloth press fit retained between a bottom of the main plate and the middle cloth releasing plate which in turn is retained against the main plate by a spring biased pair of teeth assemblies.

Referring to FIG. 1, there is illustrated a top perspective view of the assembled components of present invention apparatus to remove a cloth selected from the group consisting of a microfiber cloth and a non-woven cloth from a hand operated sweeping mop applicator without having to touch the disposable cloth (hereafter referred to as mop applicator invention 600). The mop applicator invention 600 includes a main body 10 including a top section 20 affixed to a main plate 30. The top section 20 includes a clip 610 for retaining a rotatable yolk 620 rotatably retained on a longitudinal bar 630 supported between two bar retaining housing members 640 and 650 affixed to an upper surface 12 of the top section 20. The rotatable yoke 620 retains a collar 660 into which an elongated handle (not shown) is retained. Also illustrated in FIG. 1 are two spaced apart housings, first housing 100 and second housing 200 each of which are affixed to the top surface 12 of top section 20, each housing 100 and 200 respectively retaining a spring biased retaining tooth assembly 130 and 230 which respectively are rotatably retained on a respective top 122 and 222 of first housing member 100 and a second housing member 200 and will be described in great detail later on. The first housing 100 and the second housing 200 also retain the operational mechanisms of the mop applicator invention 600.

Additional components of the mop applicator invention 600 illustrated in FIGS. 4 and 5 will now be described in detail. The additional components include a foam plate 50 having an upper surface 52 and an interior well 56 surrounded by an interior circumferential wall 54 of the foam plate 50. A middle cloth releasing plate 40 has a top surface 42 which includes affixed thereto a multiplicity of spikes, namely a first row of spikes 46 adjacent first longitudinal wall 44 of middle cloth releasing plate 40 and a second row of spikes 48 adjacent a second longitudinal wall 49 of middle cloth releasing plate 40. The middle cloth releasing plate 40 fits into the well 56 of foam plate 50 and the lower surface of the middle cloth releasing plate is permanently affixed to the well 56 of the cloth plate 50 by adhesive such as glue. The cloth 700 which is a microfiber cloth or a non-woven cloth is wrapped around the foam plate 50 and also wrapped around the portion of the middle cloth releasing plate 40 so that the cloth is retained by the row of spikes 46 and 48 of the middle cloth releasing plate when the middle cloth releasing plate is press fit against the lower surface of the main plate 30 and which has rows of openings 46H to receive a respective one of the spikes 46 and rows of openings 48H to receive the spikes 48.

Figure 2:
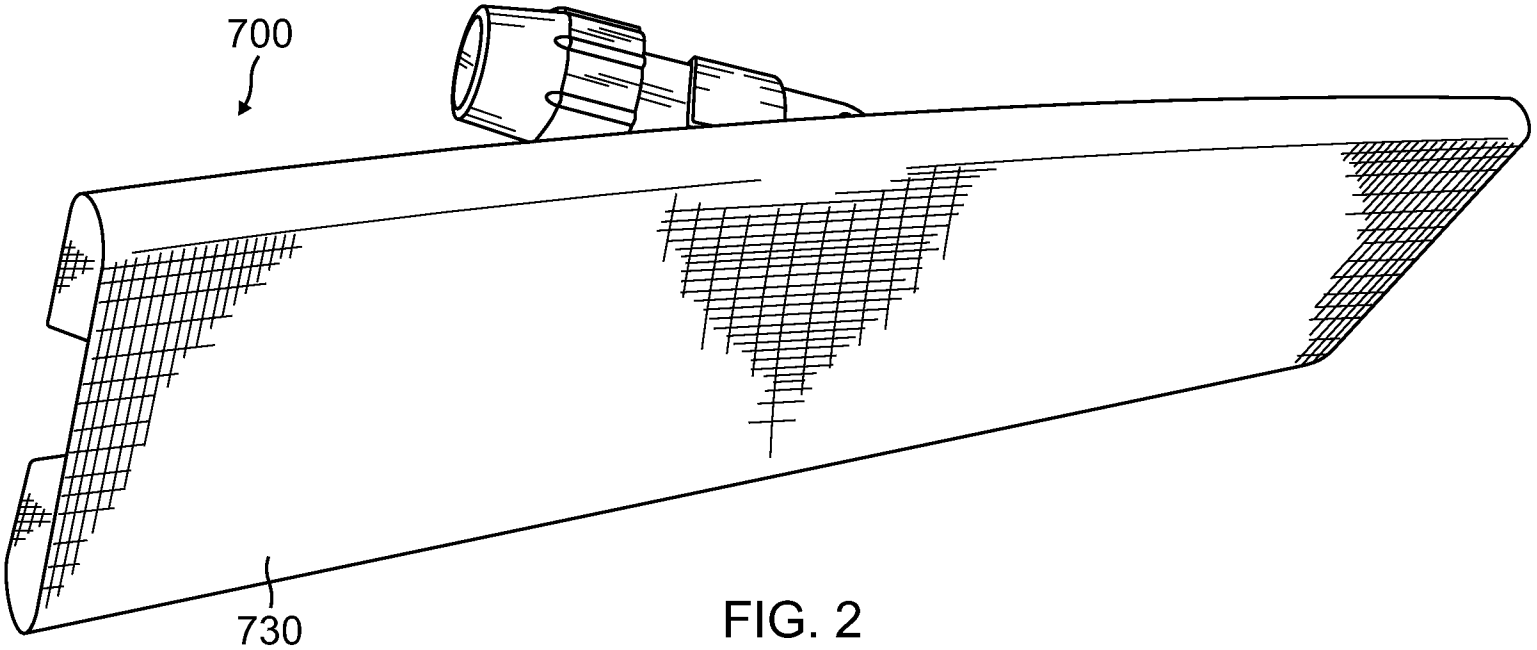
FIG. 2 is a bottom perspective view illustrating the disposable microfiber cloth retained onto the present invention.

FIG. 2 illustrates a bottom 730 of the disposable cloth 700 retained on the middle cloth releasing plate 40.

Figure 3:
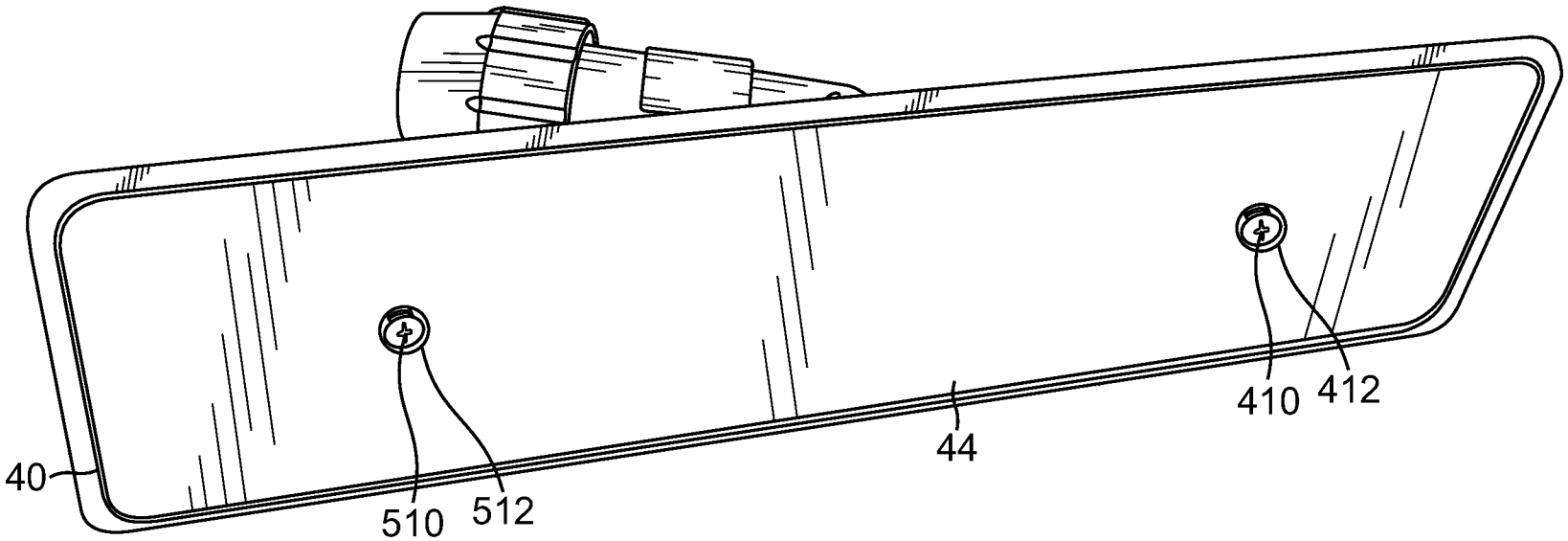
FIG. 3 is a bottom perspective view of the midddle cloth releasing plate with the foam plate removed to illustrate the middle cloth releasing plate having a pair of threaded bolts visible from the bottom of the middle cloth releasing plate.

FIG. 3 is a bottom perspective view of the middle cloth releasing plate 40 with the foam plate 50 removed to illustrate middle cloth retaining members such as the respective bottom 412 and 512 of a pair of self-tapping screws 410 and 510 which extend through the middle cloth releasing plate 40, the bottom 412 and 512 of the respective self-tapping screws 410 and 510 are visible from the bottom surface 44 of the middle cloth releasing plate 40.

Referring once again to FIG. 4, there is illustrated in FIG. 4 a top perspective view of the components of the mop applicator invention 600 illustrated in FIG. 1 with the mop applicator invention 600 in the released condition where the middle cloth releasing plate 40 illustrated above the indentation 56 of the foam plate 50 exposed (in the mop applicator 600) the middle cloth releasing plate 40 is affixed into the well 56 of the foam plate 50 and is not separated from the foam plate as illustrated in the exploded view of FIG. 4 which is illustrated for the purpose of illustrating the components) and the foam plate 50 also released so that the middle cloth releasing plate 40 and the foam plate 50 are pushed away from the bottom 34 of the main plate 30 so that the press fit retention on the disposable cloth 700 is released enabling the cloth 700 to fall away.

Figure 4:
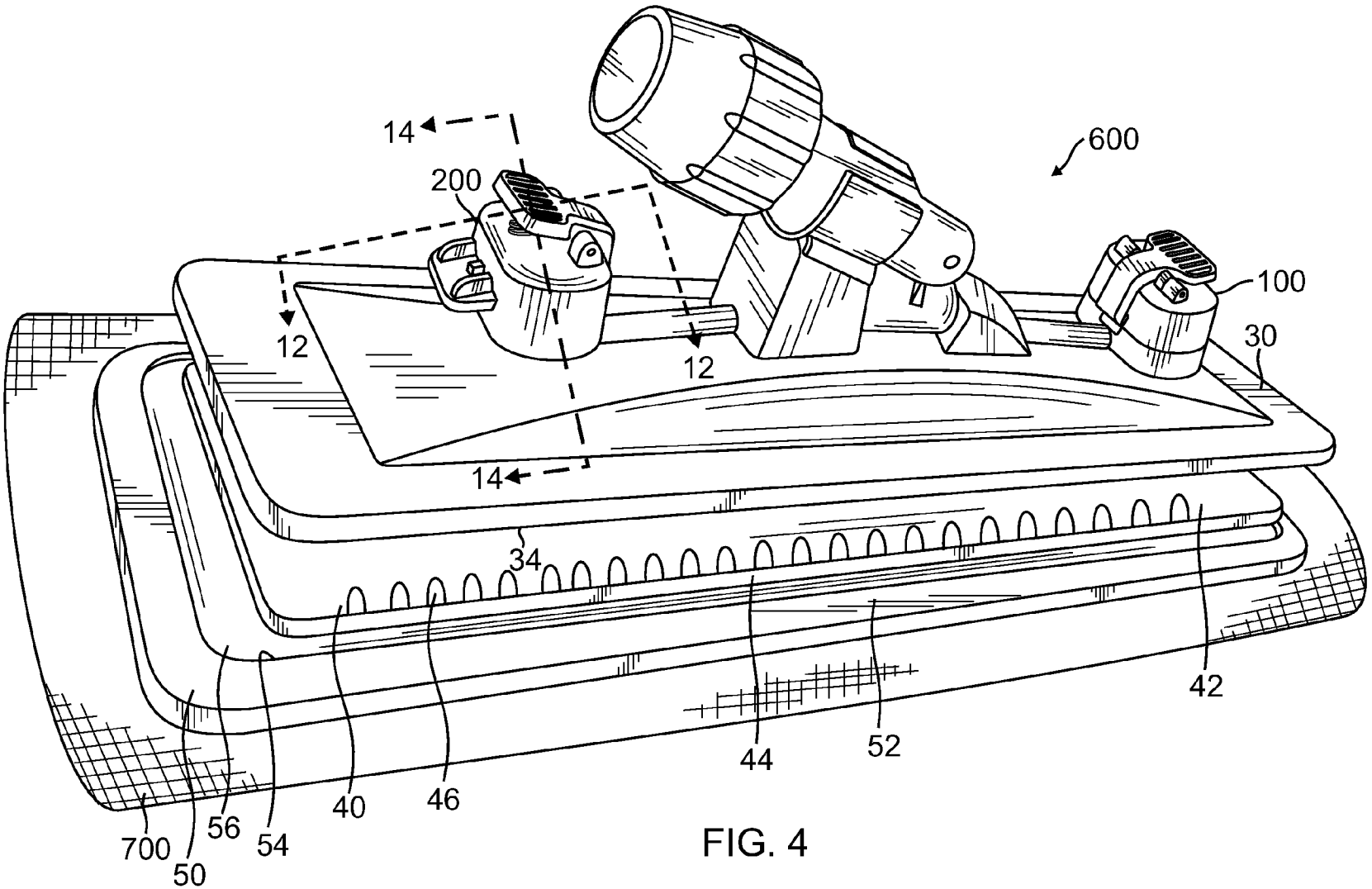
FIG. 4 is a top perspective view of the components of the present invention illustrated in FIG. 1 with the present invention in a released condition where middle cloth releasing plate and the foam plate are pushed away from the bottom of the main plate and the press fit retention on the disposable cloth is released enabling the disposable cloth to fall away.
Figure 5:
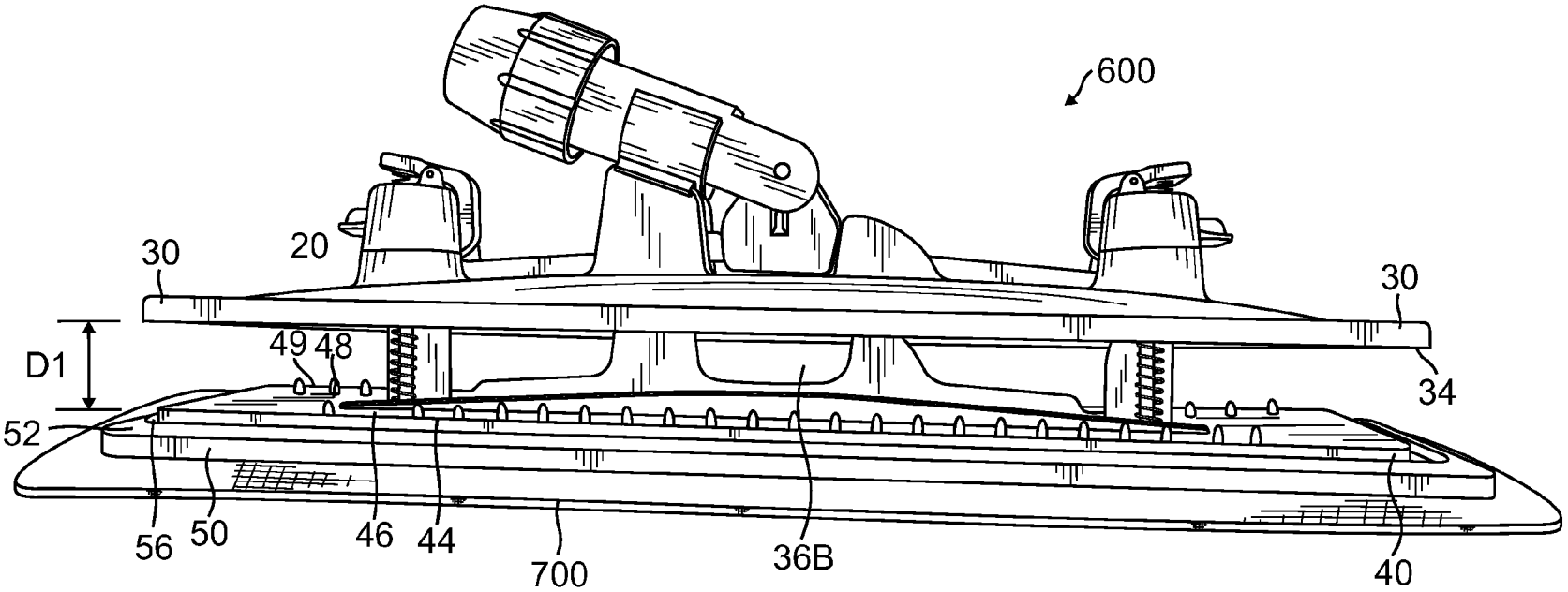
FIG. 5 is a front view of the present invention in a released condition as illustrated in FIG. 4, where the middle cloth releasing plate and foam plate are pushed away from the bottom of the main plate by the force of the compression springs and the press fit retention of the disposable cloth is released enabling the cloth to fall away, the mechanism of the present invention causing the middle cloth releasing plate and the foam plate to only fall away from the main plate by a fixed distance.

FIG. 5 is a front view of the mop applicator invention 600 in a released condition as illustrated in FIG. 4 where the middle cloth releasing plate 40 and the foam plate 50 are pushed away from the bottom 34 of the main plate 30 by the force of compression springs (See FIGS. 6) 800, 840, 900 and 940 and the press fit retention of the disposable cloth 700 is released enabling the cloth 700 to fall away. However, the releasing mechanism of mop applicator invention only permits the middle cloth releasing plate 40 and the foam plate 50 to only fall away from the main plate 30 by a fixed distance "D-1".

Figure 6:
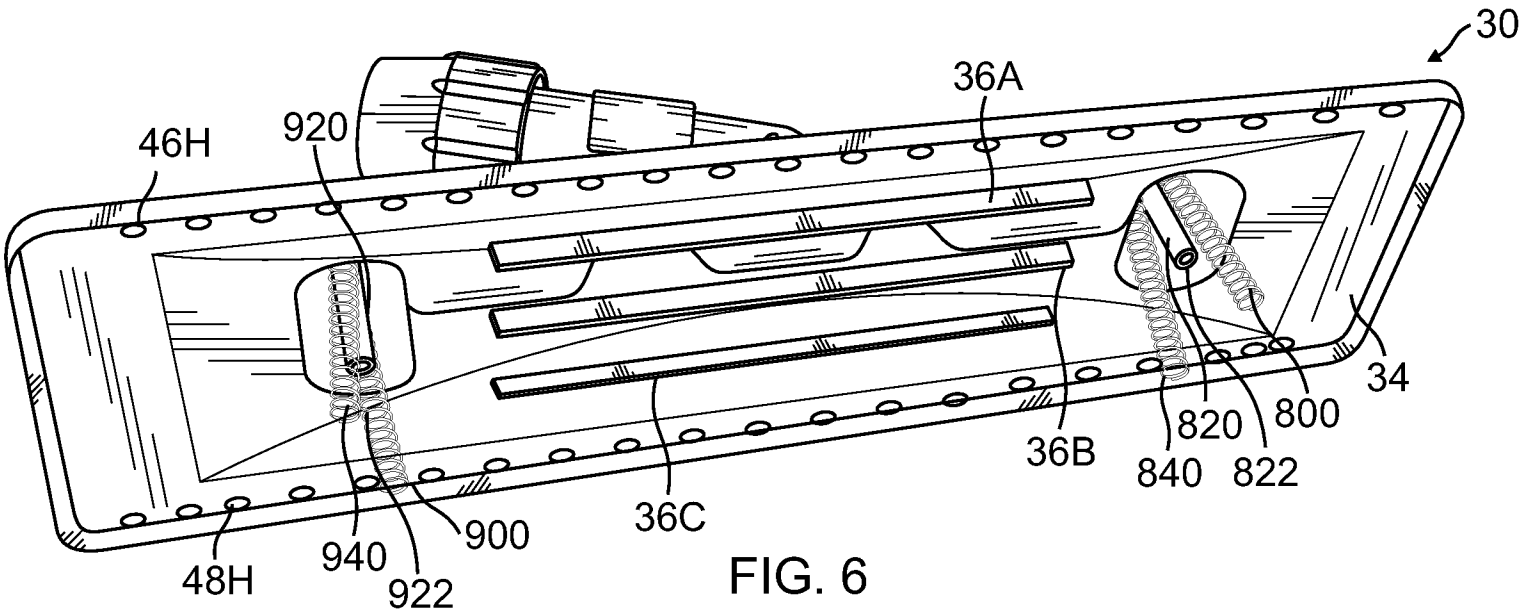
FIG. 6 is a bottom perspective view of the main plate illustrating the details of the bottom of the main plate.

FIG. 6 is a bottom perspective view of the main plate 30. The bottom 34 of the main plate 30 has three parallel strengthening ribs, first main plate rib 36A, middle main plate rib 36B and third main plate rib 36C. Anti-vibration members from the top of middle cloth releasing plate 40 are illustrated and will be discussed along with FIG. 7. FIG. 6 also illustrates first and second compression springs 800 and 840 with a first hollow shaft 820 between them (which are retained in an interior upper surface of a hollow interior of first housing 100). FIG. 6 also illustrates third and fourth compression springs 900 and 940 with a second hollow shaft 920 between them (which are retained in an interior upper surface of a hollow interior of second housing 200). In addition, there is illustrated a multiplicity of holes. A first set of holes 46H receives the multiplicity of spikes 46 from the middle cloth releasing plate 40 and an additional series of openings or holes 4811 respectively receive a spike 48 from the middle cloth releasing plate 40.

Figure 7:
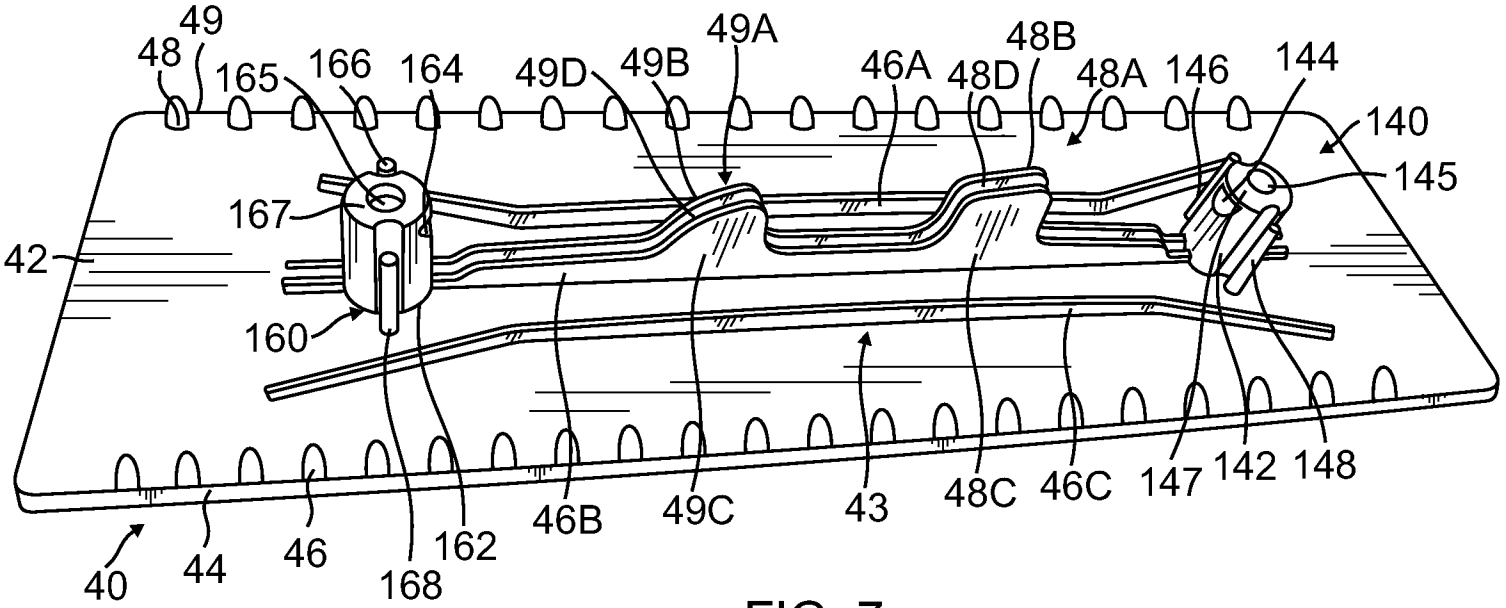
FIG. 7 is a top perspective view of the middle cloth releasing plate of the present invention.

FIG. 7 is a top perspective view of middle cloth releasing plate 40. The top 42 of the middle cloth releasing plate 40 has three additional strengthening ribs, first middle cloth releasing plate rib 46A, middle cloth releasing plate rib 46B and third middle cloth releasing plate rib 46C. Middle middle cloth releasing plate rib 46B has incorporated into it a first anti-vibration member 48A having a first extending wall 4813 and a second extending wall 48C surrounding a gap 48D between walls 48B and 48C. The middle middle cloth releasing plate rib 46B has incorporated into it a spaced apart second anti-vibration member 49A having a first extending wall 49B and a second extending wall 49C surrounded a gap 49D between walls 49B and 49C. Gaps 48D and 49D extend for the entire length of middle middle cloth releasing plate rib 46B. As illustrated in FIGS. 5 and 6, when the top 42 of middle cloth releasing plate 40 is brought into contact with the bottom 34 of main plate 30, the gaps 48D and 49D receive middle main plate rib 36B and the walls 48B and 48C and 49B and 49C surround middle main plate rib 46B to facilitate anti-vibration of the mop applicator invention 600. First main plate rib 36A rests adjacent and just outside of first middle cloth releasing plate rib 46A and third main plate rib 36C rests adjacent and just outside of third middle releasing cloth plate rib 46C, providing additional strength to the closed applicator invention 600. Also illustrated in FIG. 7 is the multiplicity of spikes in a row of spikes 46 adjacent said longitudinal side 44 and a multiplicity of spikes in a row of spikes 48 adjacent longitudinal side 49.

Referring again to FIG. 7, located at spaced apart locations along middle middle cloth releasing plate rib 46B is a first vertical housing 140 which is generally cylindrical and has an exterior wall 142 which extends perpendicularly to the top 42 of middle cloth releasing plate 40, the exterior wall 142 having a tooth receiving notch 144 facing toward the center 43 of the top 42 of middle cloth releasing plate 40. There is a central shaft 145 running through the vertical interior of first vertical housing 140, starting at the top 147. There is an oppositely disposed second vertical housing 160 which is generally cylindrical and has an exterior wall 162 which extends perpendicularly to the top 42 of middle cloth releasing plate 40, the exterior wall 162 having a tooth receiving notch 164 facing toward the center 43 of the top 42 of middle cloth releasing plate 40. There is a central shaft 165 running through the vertical interior of housing 160, starting at the top 167. A first spring retaining post 146 and a second spring post 148 are on opposite sides of first vertical housing 140. A third spring retaining post 166 and a fourth spring retaining post 168 are on opposite sides of housing 160. First vertical housing 140 and first and second spring retaining posts 146 and 148 are aligned with first housing 100 of top section 20 and second vertical housing 160 and third and fourth spring retaining posts 166 and 168 are aligned with second housing 200 of top section 20.

Figure 8:
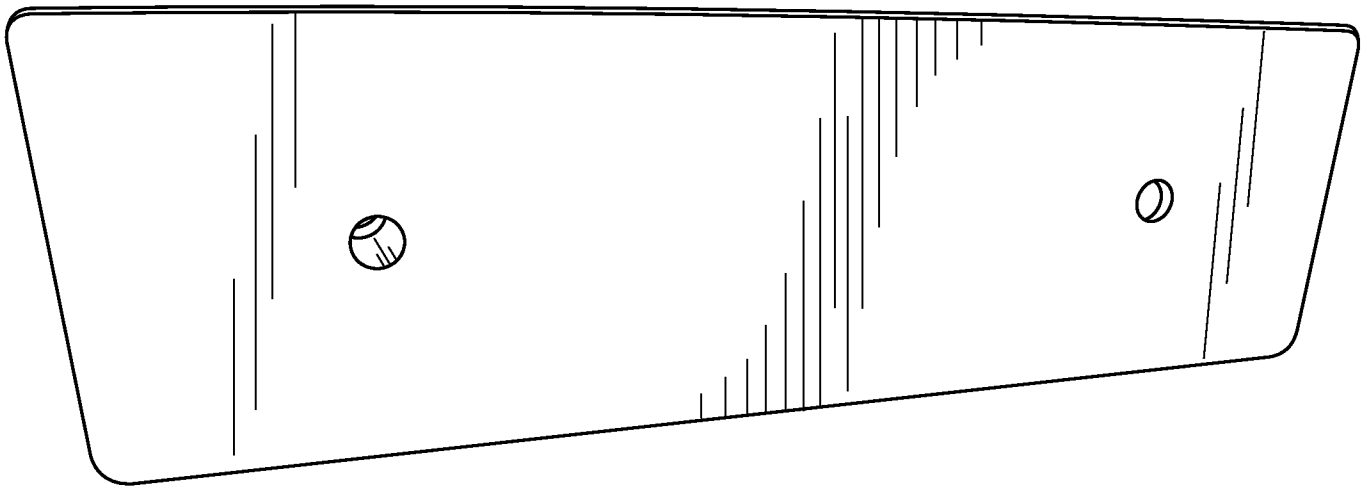
FIG. 8 is a bottom perspective view of the middle cloth releasing plate with the foam cover removed.

FIG. 8 illustrates a bottom perspective view of the middle cloth releasing plate 40 with the foam plate 50 removed.

Figure 9:
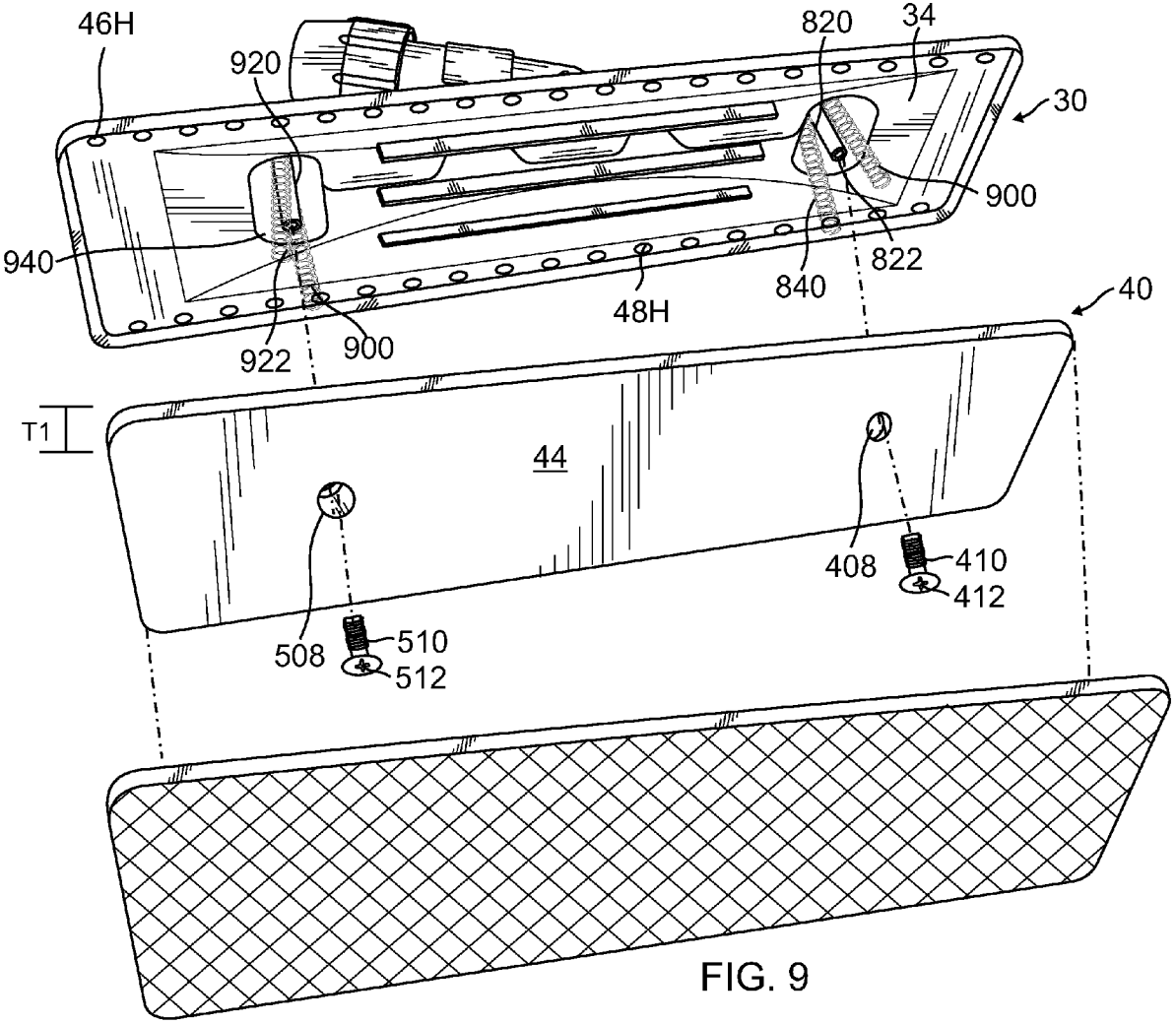
FIG. 9 is a bottom perspective exploded view of the main plate, middle cloth releasing plate and the foam cover plate.

FIG. 9 is an exploded bottom perspective view of a main plate 30, and the middle cloth releasing plate 40 removed from the foam plate 50, illustrating a pair of spaced apart transverse openings 408 and 508 which extending through the entire interior thickness "T-1" of the middle cloth releasing plate 40. Self-tapping screw 410 extends through transverse opening 408 with the bottom 412 of th self-tapping screw 410 visible from the bottom surface 44 of the middle cloth releasing plate 40. Similarly, self-tapping screw 510 extends through transverse opening 508 with the bottom 512 of the self-tapping screw 510 visible from the bottom surface 44 of the middle cloth releasing plate 40. Also illustrated are the openings or holes 46H to receive the multiplicity of spikes 46 and the multiplicity of holes 48H to receive the multiplicity of spikes 48 which are located on the bottom 34 of main plate 30.

Figure 10:
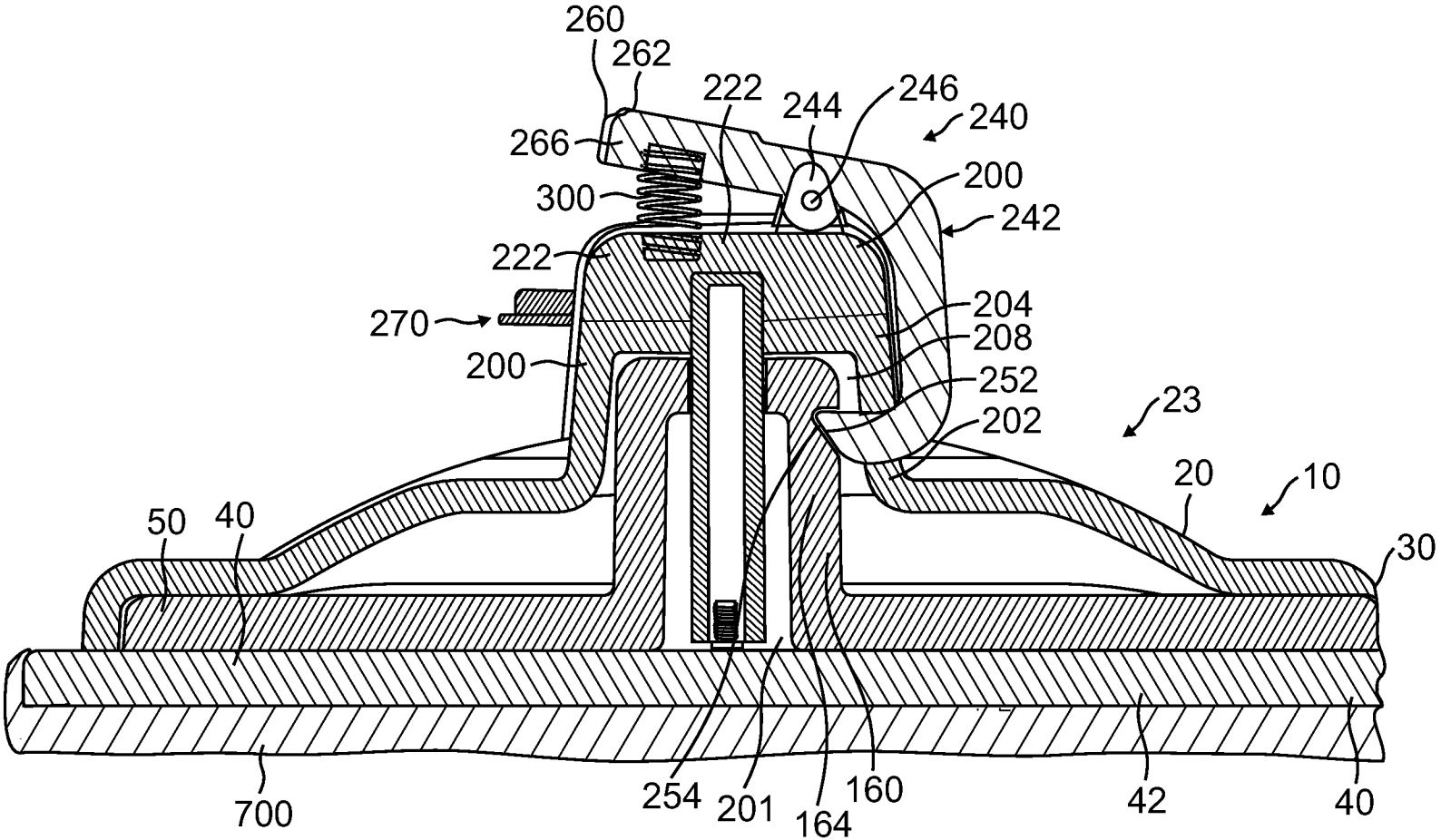
FIG. 10 is a partial longitudinal cross-sectional view of the present invention taken along line 10-10 of FIG. 1, with the disposable cloth in the retained condition.

FIG. 10 is a partial longitudinal cross-sectional view of the applicator invention 600 taken along line 10-10 of FIG. 1 illustrating the details of the operating mechanism on and within the second housing 200. The second housing 200 is affixed to top section 20 of main body 10, the second housing 200 also affixed to the main plate 30. The main plate 30 is also affixed to the main body 10. The second housing 200 has a second tooth receiving opening 202 in its sidewall 204 leading to second housing interior chamber 208, the second tooth receiving opening 202 facing the middle 23 of the top section 20. The second vertical housing 160 affixed to the upper surface 42 of the middle cloth release plate 40, the second vertical housing 240 also fits within the hollow interior 208 of second housing 200 with its tooth receiving notch 164 of its exterior wall 162 facing toward a center of 43 of the top 42 of the middle cloth releasing plate 42. Tooth receiving notch 164 is aligned with tooth receiving opening 202. The top surface 222 of second housing 200 retains second tooth retaining assembly 270 which includes a trigger 240 with an arcuate arm 242 having a transverse opening 244 rotatably supported by a pin 246 retained between a pair of posts 248 and 250 which are supported on top 222 of housing and support the pin 246 which extends through transverse opening 244 in arcuate arm 242 retained between the posts 248 and 250. The arcuate arm 242 extends at its distal end 252 to a tooth 254 which extends through tooth receiving opening 202 in second housing 200 and into tooth receiving notch 164 in second vertical housing 160. At its proximal end 260, trigger 240 has a push plate section 262. A closing biasing spring 300 is affixed to the top 222 of second housing 200 and to an underside 266 of the to push plate section 262, which biases the arcuate arm 242 and the tooth 254 at the distal end 252 of trigger 240 and into and through tooth receiving opening 202 and into tooth receiving notch 164. The middle cloth releasing plate 40 has its self-tapping screw 510 inserted into opening 922 in second hollow shaft 920 adjacent the bottom 201 of second vertical housing 200. In this manner the foam covering cloth 50 is affixed to and surrounds the middle cloth releasing plate 40 and the disposable cloth 700 which can be either a cloth or a non-woven cloth is press fit retained between the top 42 of the middle cloth releasing plate 40 and the bottom 34 of the main plate 30. Rows of spikes 46 and 48 also assist in the retention. FIG. 10 illustrated the mop applicator 600 in the unreleased condition.

Figure 11:
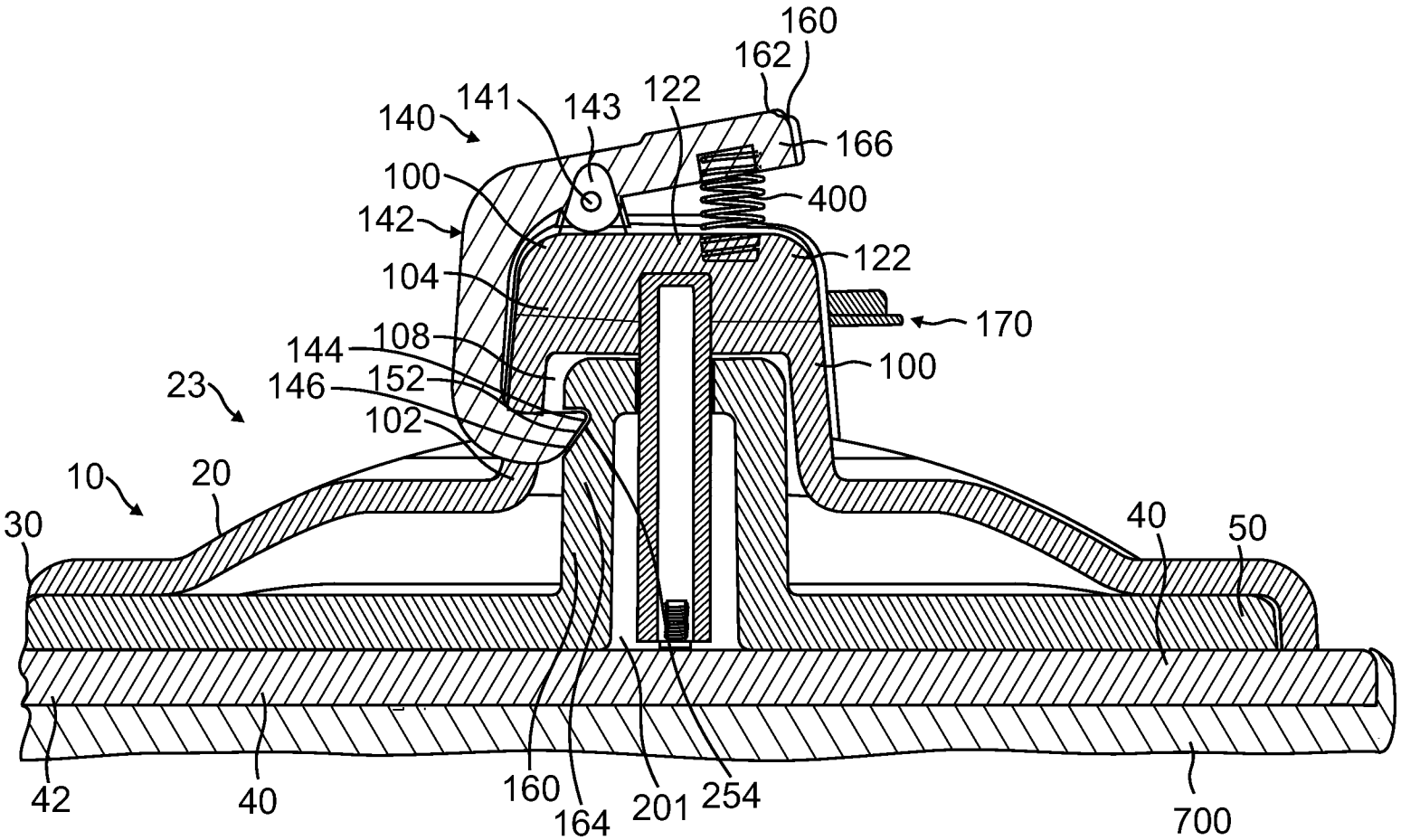
FIG. 11 is a partial longitudinal; cross-sectional view of the present invention taken along line 11-11 of FIG. 1, with the disposable cloth in the retained condition.

FIG. 11 is a partial longitudinal cross-sectional view of the applicator invention 600 taken along line 11-11 of FIG. 1 illustrating the details of the operating mechanism on and within the first housing 100. The components are a mirror image of the components in the second housing. The first housing 100 is affixed to top section 20 of main body 10, the first housing 100 also affixed to the first main plate 30. The first main plate 30 is also affixed to the main body 10. The housing 100 has a first tooth receiving opening 102 in its sidewall 104 leading to housing interior chamber 108, the tooth receiving opening 102 facing the middle 23 of the top section 20. The first vertical housing 140 affixed to the upper surface 42 of the middle cloth release plate 40, the first vertical housing 140 also fits within the hollow interior 108 of first housing 100 with its tooth receiving notch 144 of its exterior wall 142 facing toward a center of 43 of the top 42 of the middle cloth releasing plate 42. Tooth receiving notch 144 is aligned with tooth receiving opening 102. The top surface 122 of first housing 100 retains first tooth retain assembly 170 which includes a trigger 140 with an arcuate arm 142 having a transverse opening 144 rotatably supported by a pin 146 retained between a pair of posts 148 ad 150 which are supported on top 104 of housing and support the pin 146 which extends through transverse opening 144 in arcuate arm 142 retained between the posts 148 and 150. The arcuate arm 142 extends at its distal end 152 to a tooth 154 which extends through tooth receiving opening 102 in first housing 100 and into tooth receiving notch 144 in first vertical housing 140. At its proximal end 160, trigger 140 has a push plate section 162. A closing biasing spring 400 is affixed to the top 122 of first housing 100 and to an underside 166 of push plate section 162, which biases the arcuate arm 142 and the tooth 140 at the distal end 152 of trigger and into through tooth receiving opening 102 and into tooth receiving notch 144 The middle cloth releasing plate 40 has its self-tapping screw 410 inserted into opening 822 in first hollow shaft 820 adjacent the bottom 101 of first vertical housing 100. In this manner the foam covering cloth 50 is affixed to and surrounds the middle cloth releasing plate 40 and the disposable cloth 700 is press fit retained between the top 42 of the middle cloth releasing plate 40 and the bottom 34 of the main plate.

Figure 12:
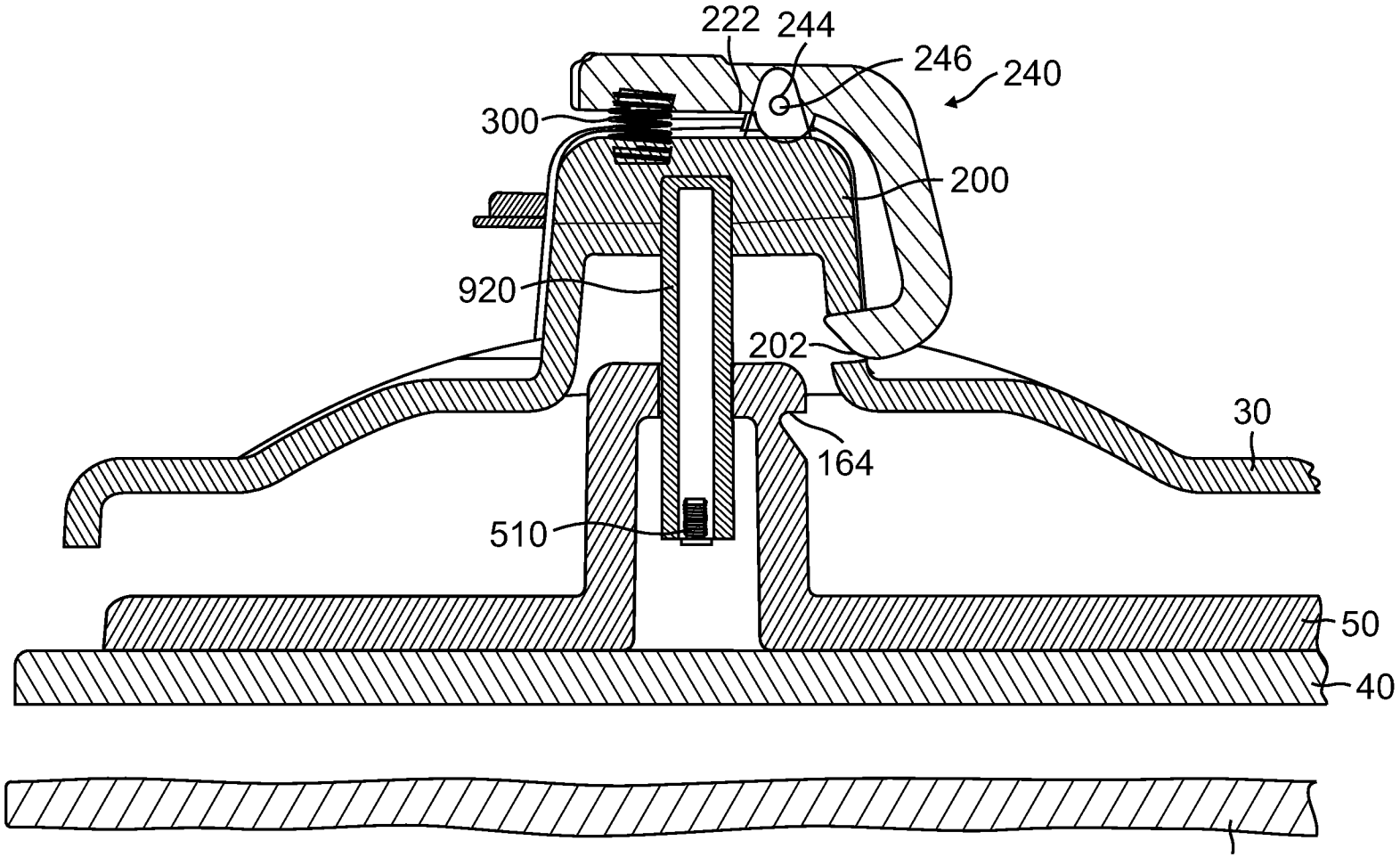
FIG. 12 is a partial longitudinal cross-sectional view of the present invention taken along line 12-12 of FIG. 4, with the disposable cloth in the released condition.
Figure 13:
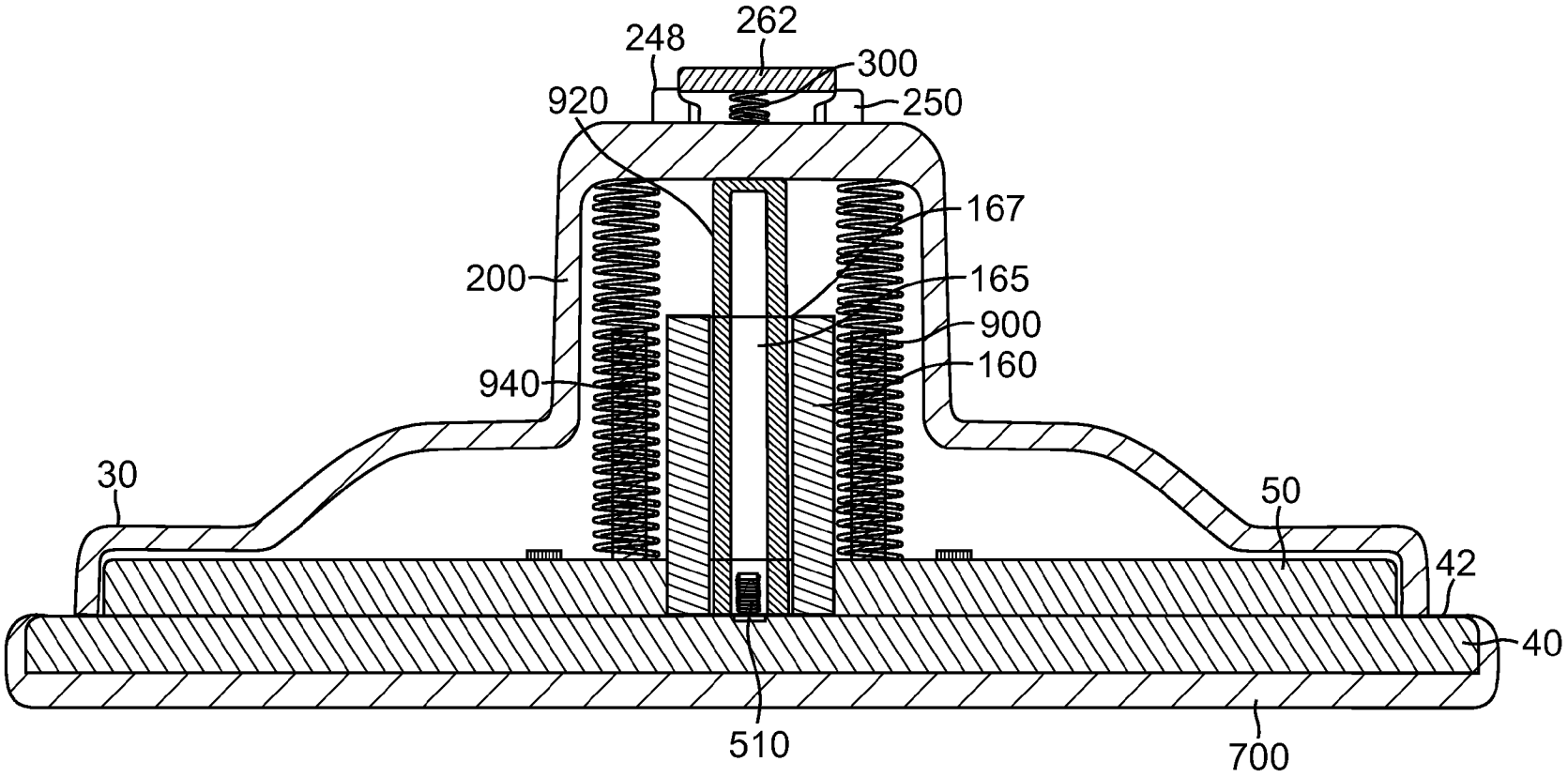
FIG. 13 is transverse cross-sectional view of the present invention taken along line 13-13 of FIG. 1, with the disposable cloth in the retained condition.
Figure 14:
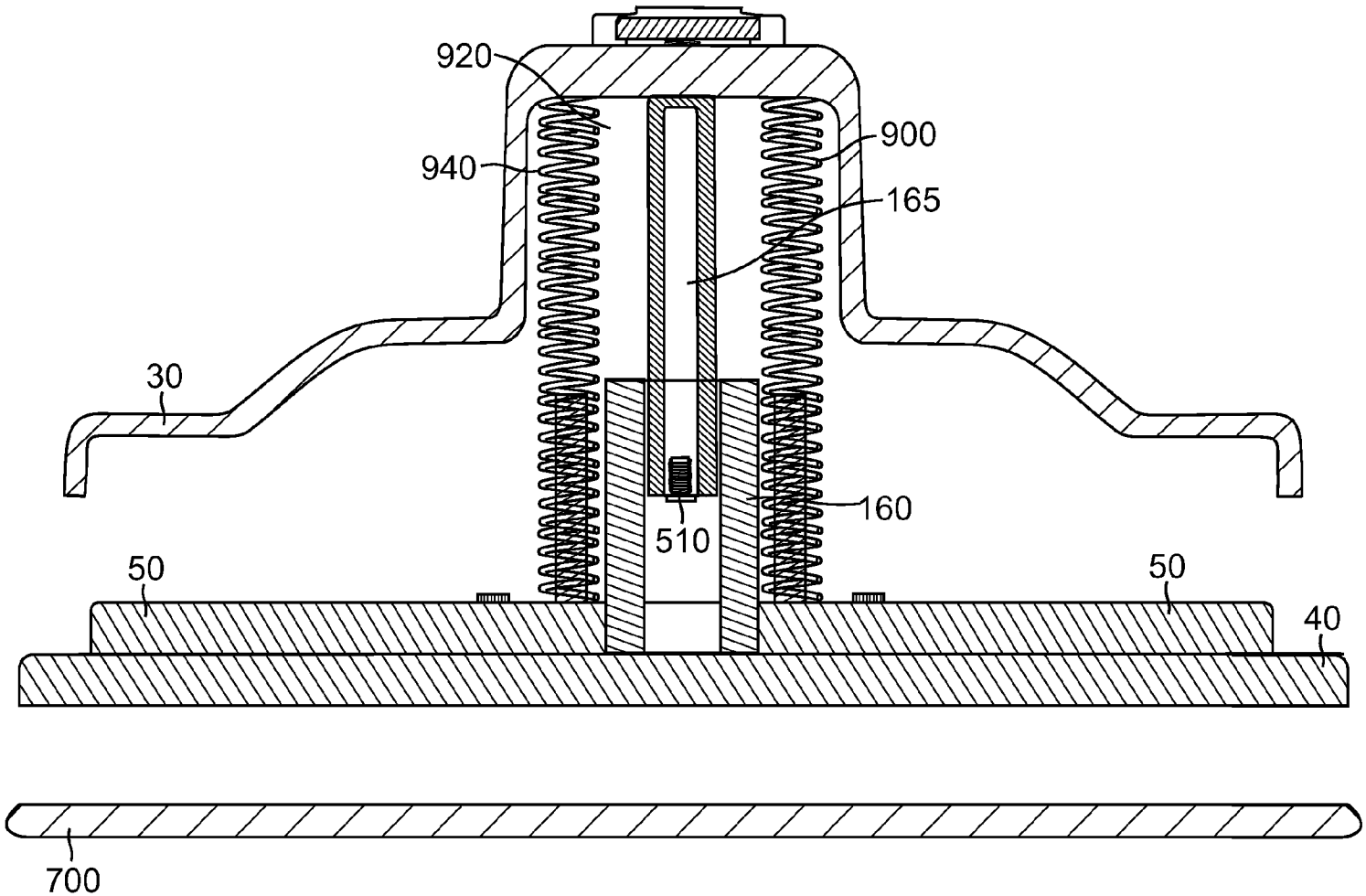
FIG. 14 is a transverse cross-sectional view of the present invention taken along line 14-14 of FIG. 4, with the disposable cloth in the released condition.

FIG. 12 is a cross-sectional view taken along line 12-12 of FIG. 4, illustrating the above described components of second housing 200 with the cloth 700 in the released conditioned. FIG. 13 is a cross-sectional view taken along line 13-13 of FIG. 1, illustrating the above described components of the second housing 200 with the cloth 700 in the retained condition. FIG. 14 is a cross-sectional view taken along line 14-14 of FIG. 4, illustrating the above described components of the second housing 200 with the cloth in the released condition.

FIGS. 12 and 14 illustrate the mop applicator 600 as illustrated in FIG. 10 in a released condition and FIG. 13 illustrates the mop applicator ib a released condition, as described above. A downward force is exerted on the push plate section 262 of trigger 240 which overcomes the closing spring force of biasing spring 300 and disengages the tooth 254 from tooth receiving notch 164 so that middle cloth releasing plate 40 and foam plate 50 are released from the main plate 30 by a downward force of force springs 900 and 940, causing the middle plate 40 and foam plate 50 to be released and move away from the bottom 34 of the main plate 30 by the distance DI so that the press fit retention of the cloth 700 is released and the cloth 700 falls away.

It will be appreciated that housing 100 hast he same corresponding components already described and will operate the same way as described in FIGS. 12 through 14.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A mop applicator, comprising:

a. a main body including a top section affixed to a main plate, the top section including a clip for retaining a rotatable yolk rotatably retained on a longitudinal bar supported between two bar retaining housing members and affixed to an upper surface of the top section, the rotatable yolk retaining a collar into which an elongated handle is retained, two spaced apart housings, a first housing and second housing affixed to the top surface of the top section, the first housing and the second housing each housing respectively retaining a spring biased retaining tooth assembly which respectively are rotatably retained on a respective top of the first housing and the second housing;

b. a middle cloth releasing plate affixed to a foam plate with a disposable cloth retained over the foam plate and partially wrapped around a top of the middle cloth releasing plate, a top of the cloth press fit retained between a the top of the middle cloth releasing plate and a bottom of the main plate, the middle cloth releasing plate moveably pressed against the main plate so that in the retained condition, the disposable cloth is also press fit retained against a bottom of the middle plate;

c. a pair of self-tapping screws extending through spaced apart openings in the middle cloth releasing plate;

d. a bottom of the main plate has three parallel strengthening ribs, first main plate rib, a middle main plate rib and third main plate rib, the top of the middle cloth releasing plate having three additional strengthening ribs, a first middle cloth releasing plate rib, a middle cloth releasing plate rib and a third middle cloth releasing plate rib, the middle middle cloth releasing plate rib having incorporated into it a first anti-vibration member having a first extending wall and a second extending wall surrounding a first gap between the walls, the middle middle cloth releasing plate rib has incorporated into it a spaced apart second anti-vibration member having a third extending wall and a fourth extending wall surrounding a second gap between the walls, when the top of the middle plate is brought into contact with the bottom of the main plate, the first and second gaps receive middle main plate rib and the first, second, third and fourth extending walls surround the middle main plate rib to facilitate anti-vibration of the mop applicator, the first main plate rib rests adjacent and just outside of first middle cloth releasing plate rib and third main plate rib rests adjacent and just outside of third middle releasing cloth plate rib, providing additional strength to the applicator mop;

e. located at spaced apart locations along middle middle—cloth releasing plate rib is a first vertical housing which is generally cylindrical and has an exterior wall which extends perpendicularly to a top of middle cloth releasing plate, the first vertical housing having an exterior wall containing a tooth receiving notch facing toward a center of the top of middle cloth releasing plate, a central shaft running through a vertical interior of first vertical housing starting at a top of the first vertical housing, a spaced apart second vertical housing is generally cylindrical and has an exterior wall which extends perpendicularly to the top of middle cloth releasing plate, the second vertical housing having an exterior wall containing a tooth receiving notch facing toward the center of the top of middle cloth releasing plate; a central shaft running through a vertical interior of housing starting at a top, a first spring retaining post and a second spring post affixed to the middle cloth releasing plate and are on opposite sides of the first vertical housing and a third spring retaining post and a fourth spring retaining post affixed to the middle cloth releasing plate are on opposite sides of second vertical housing, the first vertical housing and first and second spring retaining posts are aligned with an interior of the first housing affixed to the top section and the second vertical housing and third and fourth spring retaining posts are aligned with an interior of the second housing affixed to the top section;

f. a first transverse opening and a second spaced apart transverse opening which respectively extend through the entire interior thickness of the middle cloth releasing plate, the first self-tapping screw extending through the first transverse opening with a bottom of the first self-tapping screw visible from the bottom surface of the middle cloth releasing plate, similarly, second self-tapping screw extends through second transverse opening with a bottom of the second self-tapping screw visible from the bottom surface of the middle cloth releasing plate;

g. the first housing is affixed to top section of main body, an open interior chamber of the first housing is also aligned with a first opening extending through the main body and a first opening in the main plate; the main plate is also affixed to the main body, the first housing retaining first and second downward force compression springs and a central vertical post with an opening into which the first self-tapping screw is retained, the first and second downward force compression springs respectively retained on the first and second spring retaining posts on opposite sides of the first vertical housing; the first housing has a first tooth receiving opening in its sidewall leading to the first housing open interior chamber, the tooth receiving opening facing the middle of the top section, the first vertical housing also fits within the open interior chamber of the first housing with the tooth receiving notch of the exterior wall facing toward a center of the top of the middle cloth releasing plate, the tooth receiving notch is aligned with tooth receiving opening, a top surface of the first housing retains a first tooth retaining assembly which includes a first trigger with a first arcuate arm having a transverse opening rotatably supported by a pin retained between a pair of posts which are supported on the top surface of the first housing and support the pin which extends through a transverse opening in the first arcuate arm retained between the posts, the first arcuate arm extends at its distal end to a first tooth which extends through tooth receiving opening in first housing and into the tooth receiving notch in the first vertical housing, at its distal end, at its proximal end the first trigger has a first push plate section, a first closing biasing spring is affixed to the top of the first housing and to an underside of the first push plate section which biases the first arcuate arm and the tooth at the distal end of the trigger and into and through tooth receiving opening and into tooth receiving notch, the middle cloth releasing plate has its self-tapping screw inserted into an opening the first hollow shaft adjacent the bottom of first vertical housing. the first tooth biased into the notch overcomes the downward force of the first compression springs and in this manner the foam covering cloth is affixed to and surrounds the middle cloth releasing plate and the disposable cloth is press fit retained between the top of the middle cloth releasing plate and the bottom of the main plate;

h. the second housing is affixed to top section of main body, an open interior chamber of the second housing is also aligned with a second opening extending through the main body and a second opening in the main plate; the main plate is also affixed to the main body, the second housing retaining third and fourth downward force compression springs and a second central vertical post with an opening into which the second self-tapping screw is retained, the third and fourth downward force compression springs respectively retained on the third and fourth spring retaining posts on opposite sides of the second vertical housing; the second housing has a second tooth receiving opening in its sidewall leading to the second housing open interior chamber, the tooth receiving opening facing the middle of the top section, the second vertical housing also fits within the open interior chamber of the second housing with the tooth receiving notch of the exterior wall facing toward a center of the top of the middle cloth releasing plate, the tooth receiving notch is aligned with tooth receiving opening, a top surface of the second housing retains a second tooth retaining assembly which includes a second trigger with a second arcuate arm having a transverse opening rotatably supported by a pin retained between a pair of posts which are supported on the top surface of the second housing and support the pin which extends through a transverse opening in the second arcuate arm retained between the posts, the second arcuate arm extends at its distal end to a second tooth which extends through tooth receiving opening in second housing and into the tooth receiving notch in the second vertical housing, at its distal end, at its proximal end the second trigger has a second push plate section, a second closing biasing spring is affixed to the top of the second housing and to an underside of the second push plate section which biases the second arcuate arm and the tooth at the distal end of the second trigger and into and through tooth receiving opening and into tooth receiving notch, the middle cloth releasing plate has its self-tapping screw inserted into an opening the second hollow shaft adjacent the bottom of first vertical housing. the second tooth biased into the notch overcomes the downward force of the third and fourth compression springs and in this manner the foam covering cloth is affixed to and surrounds the middle cloth releasing plate and the disposable cloth is press fit retained between the top of the middle cloth releasing plate and the bottom of the main plate; and i. for each first housing and first trigger assembly and second housing and second trigger assembly, the disposable cloth is in a retained condition when a respective tooth of a respective trigger is retained in a respective notch, and a downward force on each respective push plate of each respective trigger overcomes the closing spring force of the first and second biasing spring and disengages the respective first and second tooth from a respective receiving notch so that the downward force from the first, second, third and fourth compression springs push the middle cloth releasing plate and foam plate away from the main plate by a given distance causing the press fit of the middle cloth releasing plate and cloth cover plate and disposable cloth against the bottom of the main plate to be released so that the disposable cloth falls away while the middle cloth releasing plate and cover plate are retained at a given distance from the main plate.

2. The mop applicator in accordance with claim 1, further comprising: the disposable cloth is selected from the group consisting of microfiber cloth and non-woven cloth.

3. The mop applicator in accordance with claim 1, further comprising:

a. the middle cloth releasing plate further includes a first row of spikes adjacent one longitudinal side and a second row of spikes adjacent a second longitudinal side;

b. the bottom of the main plate includes a first row of openings to receive the first row of spikes and a second row of openings to receive the second row of spikes; and c. the first and second row of spikes assist in retaining the disposable cloth as part of the press fit retention.

4. A mop applicator, comprising:

a. a main body including a top section affixed to a main plate, the top section including apparatus to retain an assembly for rotatably retaining a mop handle, includes a first housing and second housing affixed to the top surface of the top section, the first housing and the second housing each housing respectively retaining a spring biased retaining tooth assembly which respectively are rotatably retained on a respective top of the first housing and the second housing;

b. a middle cloth releasing plate affixed to a foam plate with a cloth retained over the foam plate and partially wrapped around a top of the middle cloth releasing plate, a top of the cloth press fit retained between a the top of the middle cloth releasing plate and a bottom of the main plate, the middle cloth releasing plate moveably pressed against the main plate so that in the retained condition, the cloth is also press fit retained against a bottom of the middle plate;

c. a pair of retaining members extending through spaced apart openings in the middle cloth releasing plate;

d. a bottom of the main plate has three parallel strengthening ribs, first main plate rib, a middle main plate rib and third main plate rib, the top of the middle cloth releasing plate having three additional strengthening ribs, a first middle cloth releasing plate rib, a middle cloth releasing plate rib and a third middle cloth releasing plate rib, the middle middle cloth releasing plate rib having incorporated into it a first anti-vibration member having a first extending wall and a second extending wall surrounding a first gap between the walls, the middle middle cloth releasing plate rib has incorporated into it a spaced apart second anti-vibration member having a third extending wall and a fourth extending wall surrounding a second gap between the walls, when the top of the middle plate is brought into contact with the bottom of the main plate, the first and second gaps receive middle main plate rib and the first, second, third and fourth extending walls surround the middle main plate rib to facilitate anti-vibration of the mop applicator, the first main plate rib rests adjacent and just outside of first middle cloth releasing plate rib and third main plate rib rests adjacent and just outside of third middle releasing cloth plate rib, providing additional strength to the applicator mop;

e. located at spaced apart locations along middle middle cloth releasing plate rib is a first vertical housing which is generally cylindrical and has an exterior wall which extends perpendicularly to a top of middle cloth releasing plate, the first vertical housing having an exterior wall containing a tooth receiving notch facing toward a center of the top of middle cloth releasing plate, a central shaft running through a vertical interior of first vertical housing starting at a top of the first vertical housing, a spaced apart second vertical housing is generally cylindrical and has an exterior wall which extends perpendicularly to the top of middle cloth releasing plate, the second vertical housing having an exterior wall containing a tooth receiving notch facing toward the center of the top of middle cloth releasing plate; a central shaft running through a vertical interior of housing starting at a top, a first spring retaining post and a second spring post affixed to the middle cloth releasing plate and are on opposite sides of the first vertical housing and a third spring retaining post and a fourth spring retaining post affixed to the middle cloth releasing plate are on opposite sides of second vertical housing, the first vertical housing and first and second spring retaining posts are aligned with an interior of the first housing affixed to the top section and the second vertical housing and third and fourth spring retaining posts are aligned with an interior of the he second housing affixed to the top section;

f. a first transverse opening and a second spaced apart transverse opening which extends through the entire interior thickness of the middle cloth releasing plate, the first retaining member extending through the first transverse opening and a second retaining member extending through the second transverse opening;

g. the first housing is affixed to top section of main body, an open interior chamber of the first housing is also aligned with a first opening extending through the main body and a first opening in the main plate; the main plate is also affixed to the main body, the first housing retaining first and second downward force compression springs and a central vertical post with an opening into which the first retaining member is retained, the first and second downward force compression springs respectively retained on the first and second spring retaining posts on opposite sides of the first vertical housing; the first housing has a first tooth receiving opening in its sidewall leading to the first housing open interior chamber, the tooth receiving opening facing the middle of the top section, the first vertical housing also fits within the open interior chamber of the first housing with the tooth receiving notch of the exterior wall facing toward a center of the top of the middle cloth releasing plate, the tooth receiving notch is aligned with tooth receiving opening, a top surface of the first housing retains a first tooth retaining assembly which includes a first trigger with a first arcuate aim having a transverse opening rotatably supported by a pin retained between a pair of posts which are supported on the top surface of the first housing and support the pin which extends through a transverse opening in the first arcuate arm retained between the posts, the first arcuate arm extends at its distal end to a first tooth which extends through tooth receiving opening in first housing and into the tooth receiving notch in the first vertical housing, at its distal end, at its proximal end the first trigger has a first push plate section, a first closing biasing spring is affixed to the top of the first housing and to an underside of the first push plate section which biases the first arcuate arm and the tooth at the distal end of the trigger and into and through tooth receiving opening and into tooth receiving notch, the middle cloth releasing plate has its self-tapping screw inserted into an opening the first hollow shaft adjacent the bottom of first vertical housing. the first tooth biased into the notch overcomes the downward force of the first compression springs and in this manner the foam covering cloth is affixed to and surrounds the middle cloth releasing plate and the disposable cloth is press fit retained between the top of the middle cloth releasing plate and the bottom of the main plate;

h. the second housing is affixed to top section of main body, an open interior chamber of the second housing is also aligned with a second opening extending through the main body and a second opening in the main plate; the main plate is also affixed to the main body, the second housing retaining third and fourth downward force compression springs and a second central vertical post with an opening into which the second retaining member is retained, the third and fourth downward force compression springs respectively retained on the third and fourth spring retaining posts on opposite sides of the second vertical housing; the second housing has a second tooth receiving opening in its sidewall leading to the second housing open interior chamber, the tooth receiving opening facing the middle of the top section, the second vertical housing also fits within the open interior chamber of the second housing with the tooth receiving notch of the exterior wall facing toward a center of the top of the middle cloth releasing plate, the tooth receiving notch is aligned with tooth receiving opening, a top surface of the second housing retains a second tooth retaining assembly which includes a second trigger with a second arcuate arm having a transverse opening rotatably supported by a pin retained between a pair of posts which are supported on the top surface of the second housing and support the pin which extends through a transverse opening in the second arcuate arm retained between the posts, the second arcuate arm extends at its distal end to a second tooth which extends through tooth receiving opening in second housing and into the tooth receiving notch in the second vertical housing, at its distal end, at its proximal end the second trigger has a second push plate section, a second closing biasing spring is affixed to the top of the second housing and to an underside of the second push plate section which biases the second arcuate aim and the tooth at the distal end of the second trigger and into and through tooth receiving opening and into tooth receiving notch, the middle cloth releasing plate has its self-tapping screw inserted into an opening the second hollow shaft adjacent the bottom of first vertical housing. the second tooth biased into the notch overcomes the downward force of the third and fourth compression springs and in this manner the foam covering cloth is affixed to and surrounds the middle cloth releasing plate and the disposable cloth is press fit retained between the top of the middle cloth releasing plate and the bottom of the main plate; and i. for each first housing and first trigger assembly and second housing and second trigger assembly, the cloth is in a retained condition when a respective tooth of a respective trigger is retained in a respective notch, and a downward force on each respective push plate of each respective trigger overcomes the closing spring force of the first and second biasing spring and disengages the respective first and second tooth from a respective receiving notch so that the downward force from the first, second, third and fourth compression springs push the middle cloth releasing plate and foam plate away from the main plate by a given distance causing the press fit of the middle cloth releasing plate and cloth cover plate and cloth against the bottom of the main plate to be released so that the cloth falls away while the middle cloth releasing plate and cover plate are retained at a given distance from the main plate.

5. The mop applicator in accordance with claim 4, further comprising: the cloth is selected from the group consisting of microfiber cloth and non-woven cloth.

6. The mop applicator in accordance with claim 4, further comprising:

a. the middle cloth releasing plate further includes a first row of spikes adjacent one longitudinal side and a second row of spikes adjacent a second longitudinal side;

b. the bottom of the main plate includes a first row of openings to receive the first row of spikes and a second row of openings to receive a second row of spikes; and c. the first and second row of spikes assist in retaining the disposable cloth as part of the press fit retention.

* * * * *